US005477836A

United States Patent [19]

Hyodo et al.

[11] Patent Number: 5,477,836

[45] Date of Patent: Dec. 26, 1995

[54] FUEL VAPOR EMISSION CONTROL SYSTEM FOR AN ENGINE

[75] Inventors: Yoshihiko Hyodo, Susono; Ryuichi Deguchi, Shimizu, both of Japan

[73] Assignee: Toyota Jidosha Kabushiki Kaisha, Toyota, Japan

[21] Appl. No.: 380,880

[22] Filed: Jan. 30, 1995

[30] Foreign Application Priority Data

Feb. 2, 1994 [JP] Japan ..... 6-010996

[51] Int. Cl.[6] ..... F02M 33/02; F02M 25/08

[52] U.S. Cl. ..... 123/519; 123/520

[58] Field of Search ..... 123/516, 518, 123/519, 520

[56] References Cited

U.S. PATENT DOCUMENTS

| | | | |
|---|---|---|---|
| 4,790,283 | 12/1988 | Uranishi et al. | 123/519 |
| 4,815,436 | 3/1989 | Sasaki et al. | 123/520 |
| 4,817,576 | 4/1989 | Abe et al. | 123/519 |
| 4,887,578 | 12/1989 | Woodcock et al. | 123/519 |
| 5,056,494 | 10/1991 | Kayanuma | 123/519 |
| 5,111,795 | 5/1992 | Thompson | 123/519 |
| 5,143,041 | 9/1992 | Franzke | 123/520 |
| 5,209,210 | 5/1993 | Ikeda et al. | 123/520 |
| 5,235,955 | 8/1993 | Osaki | 123/520 |
| 5,337,721 | 8/1994 | Kasuya et al. | 123/519 |
| 5,355,861 | 10/1994 | Arai | 123/519 |

FOREIGN PATENT DOCUMENTS

| | | |
|---|---|---|
| 63-198462 U | 12/1988 | Japan . |
| 64-53450 U | 4/1989 | Japan . |
| 1-134767 U | 9/1989 | Japan . |

*Primary Examiner*—Thomas N. Moulis
*Attorney, Agent, or Firm*—Kenyon & Kenyon

[57] ABSTRACT

A fuel vapor emission control system for connection to an engine having a fuel tank, so as to purge fuel vapor introduced thereto into the engine, comprises primary and secondary adsorbing layers for temporarily adsorbing fuel vapor introduced thereto. The primary and the secondary layers are connected in series. The air is introduced into, in turn, the primary and the secondary layers so that the air passing therethrough desorbs fuel vapor therefrom, and then into the engine, together with fuel vapor desorbed from the primary and the secondary layers, when the engine is running. During an engine fuelling operation, fuel vapor is introduced from the fuel tank to the primary layer. When the engine is running, fuel vapor is introduced, from the fuel tank, into the engine by bypassing the primary and the secondary layers.

16 Claims, 8 Drawing Sheets

FUEL VAPOR EMISSION CONTROL SYSTEM FOR AN ENGINE

BACKGROUND OF THE INVENTION

1. Field of the Invention

The present invention relates to a fuel vapor emission control system for an engine.

2. Description of the Related Art

There is known a fuel vapor emission control system for an engine having a fuel tank, the system having an adsorbing layer of activated carbon for temporarily adsorbing fuel vapor introduced from the fuel tank thereto, wherein air is introduced into the layer so that the air passing therethrough desorbs fuel vapor adsorbed within the layer, and that fuel vapor, together with the air, is purged into the engine.

During, for example, an engine fuelling operation, an amount of fuel vapor generated within the fuel tank is large. Therefore, just after the fuelling operation, an amount of fuel vapor adsorbed in the layer is large. In this situation, however, if the engine operates, and the air is introduced into the layer, a large amount of fuel vapor is desorbed from the primary layer. Accordingly, a large amount of fuel vapor is purged into the engine. This makes it difficult to control the air-fuel ratio in the engine, and the amount of unburned hydrocarbon discharged into the exhaust passage of the engine can become large.

To solve this problem, Japanese Unexamined Utility Model Publication No. 63-198462 discloses a fuel vapor emission control system for an engine having a fuel tank, the system having primary and secondary adsorbing layers for temporarily adsorbing fuel vapor introduced thereto, the primary and the secondary layers being connected in series, wherein the air passed through the primary layer is introduced to the secondary layer so that the air passing therethrough desorbs fuel vapor adsorbed within the primary and the secondary layers therefrom, and that fuel vapor, together with the air, is fed into the engine, and wherein fuel vapor is introduced from the fuel tank to the primary layer. In this system, fuel vapor desorbed from the primary layer is temporarily adsorbed within the secondary layer, and a large amount of fuel vapor is prevented from being purged into the engine.

In this connection, just before the engine fuelling operation, since the amount of liquid fuel in the fuel tank is generally small, liquid fuel in the fuel tank may easily evaporate. In the system described above, fuel vapor generated when the engine is running is also introduced into the primary layer, and fuel vapor desorbed from the primary layer is then introduced to the secondary layer and temporarily adsorbed therein. To this end, when the fuelling operation is to be carried out, the large amount of fuel vapor is adsorbed in the secondary layer. Thus, a problem arises that the adsorbing capacity of the secondary layer can be small when the fuelling operation is to be carried out.

SUMMARY OF THE INVENTION

An object of the present invention is to provide a fuel vapor emission control system capable of preventing a large amount of fuel vapor from being purged into the engine while preventing fuel vapor from being discharged into the outside air.

According to the present invention, there is provided a fuel vapor emission control system for connection to an engine having a fuel tank so as to purge fuel vapor introduced thereto into the engine, the system comprising: primary and secondary adsorbing layers for temporarily adsorbing fuel vapor introduced thereto, the primary and the secondary layers being connected in series; fuel vapor introducing means for introducing fuel vapor, from the fuel tank, into the primary layer during an engine fuelling operation, and for introducing fuel vapor from the fuel tank into the engine bypassing the primary and the secondary layers when the engine is running; and air introducing means for introducing air into, in turn, the primary and the secondary layers so that the air passing therethrough desorbs fuel vapor therefrom, and then into the engine, together with the fuel vapor desorbed from the primary and the secondary layers, when the engine is running.

The present invention may be more fully understood from the description of the preferred embodiments of the invention as set forth below, together with the accompanying drawings.

DESCRIPTION OF THE PREFERRED EMBODIMENTS

Figure 1:
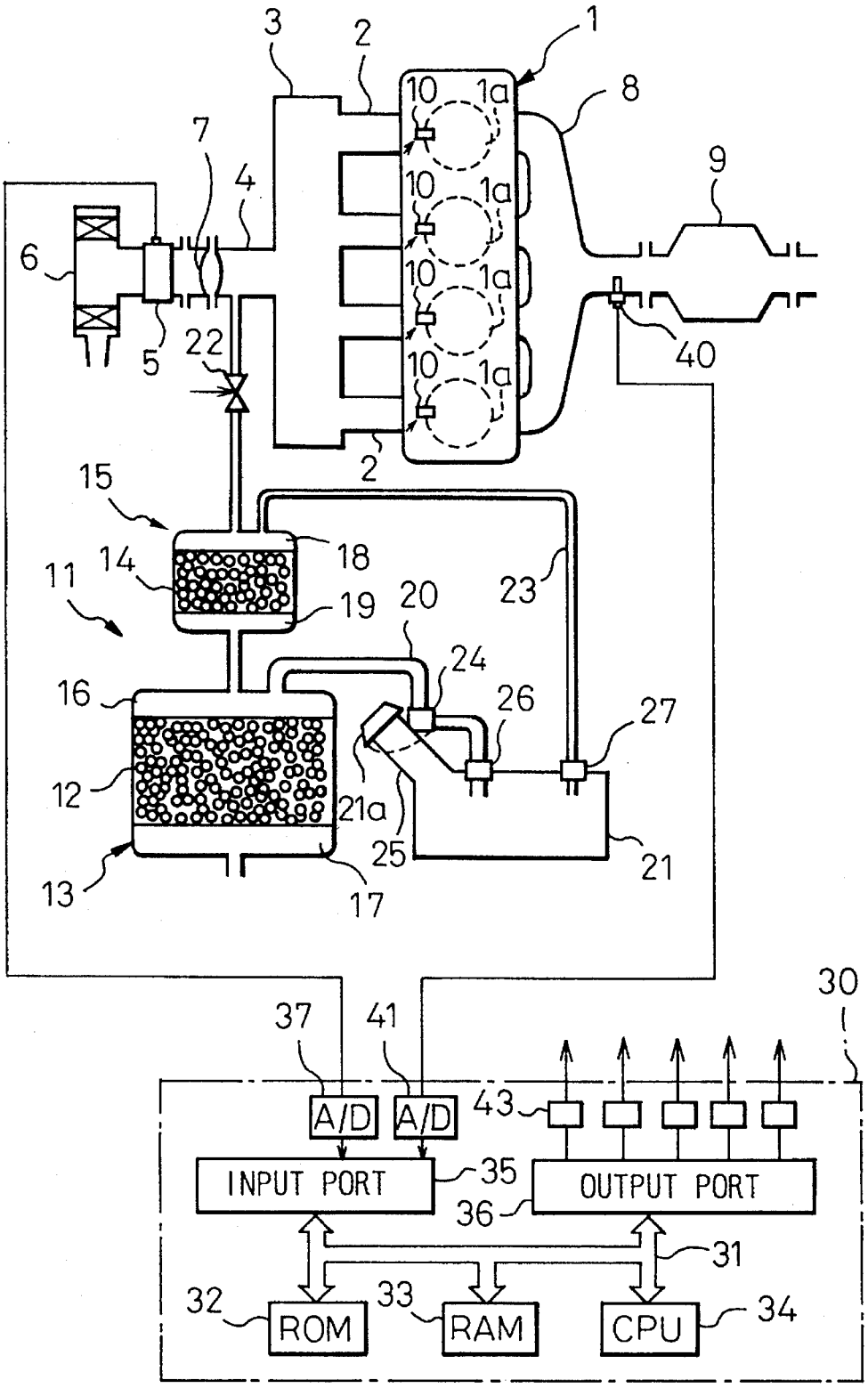
FIG. 1 is a general view of an engine.

Referring to FIG. 1, an engine body 1 has four cylinders 1*a* and each cylinder 1*a* is connected to a common surge tank 3 via a corresponding branch pipe 2; the surge tank 3 is connected to an air flow meter 5 via an intake duct 4. The air flow meter 5 is connected to an air cleaner 6. A throttle valve 7 is arranged in the intake duct 4. Further, the cylinders 1*a* are connected to an exhaust manifold 8, and the exhaust manifold 8 is connected to a three-way catalytic converter 9. Fuel injectors 10 are provided for the corresponding cylinders la and are controlled by signals output from an electronic control unit 30.

As illustrated in FIG. 1, a fuel vapor emission control system 11 for purging fuel vapor into the intake duct 4 is provided. This system 11 comprises a primary charcoal canister 13 having a primary adsorbing layer of activated carbon 12 therein, and a secondary charcoal canister 15 having a secondary adsorbing layer of activated carbon 14 therein. The primary and the secondary canisters 13 and 15 are connected in series. An air-outlet chamber 16 and an air-inlet chamber 17 are formed within the primary canister 13 on each side of the primary layer 12. Also, another air-outlet chamber 18 and another air-inlet chamber 19 are formed within the secondary canister 15 on each side of the secondary layer 14.

The air-inlet chamber for the primary layer 17 is connected to the outside air. The air-outlet chamber for the primary layer 16 is connected to the air-inlet chamber for the secondary layer 19, and to a fuel tank 21 via a first pipe 20. The first pipe 20 allows fuel vapor to flow therethrough only when a fuelling operation, into the fuel tank 21, is carried out. The air-outlet chamber for the secondary layer 18 is connected to the intake duct 4 downstream of the throttle valve 7, via a solenoid valve 22. The solenoid valve 22 is driven by signals output from the electronic control unit 30, and is duty-controlled at a duty-cycle thereof. Further, the air-outlet chamber for the secondary layer 18 is connected to the fuel tank 21 via a second pipe 23. In this first embodiment, the cross-sectional area of the first pipe 20 is made larger than that of the second pipe 23, and the length of the first pipe 20 is made shorter than that of the second pipe 23, so that the flow resistance of the first pipe 20 is smaller than that of the second pipe 23.

A vent valve 24 is provided in the first pipe 20. This valve 24 cooperates with a cover 21*a*, which is provided at an opening of a fuel inlet 25 of the fuel tank 21, so as to allow fuel vapor to flow through the first pipe 20 only during the fuelling operation. That is, when the cover 21*a* is attached to the fuel tank 21 so as to close the fuel inlet 25, the valve 24 closes the first pipe 20, and, when the cover 21*a* is removed from the fuel tank 21 so that the fuel inlet 25 is opened, the valve 24 opens the first pipe 20. Alternatively, a determining device may be provided for determining whether the fuelling operation is being carried out. The determining device may operates it by electrically determining, for example, whether the cover 21*a* is removed from the tank 21, or whether the fuelling nozzle is inserted into the fuel inlet 25. In this case, a solenoid valve can be used as a valve 24, and this solenoid valve is driven so as to open the first pipe 20 when the determining device determines that the fuelling operation is being carried out, and to close the first pipe 20 when the determining device determines that the fuelling operation is not being carried out.

As shown in FIG. 1, the first and the second pipes 20 and 23 are connected to the fuel tank 21, via valves 26 and 27. The valves 26 and 27 function to prevent leakage of fuel from the fuel tank 21 to the outside when a vehicle having the engine 1 is accidentally rolled over.

The electronic control unit 30 is constructed as a digital computer and comprises ROM (read only memory) 32, RAM (random access memory) 33, a CPU (microprocessor, etc.) 34, an input port 35 and an output port 36. The ROM 32, RAM 33, CPU 34, the input port 35 and the output port 36 are interconnected to each other via a bidirectional bus 31.

The air flow meter 5 produces an output voltage proportional to the amount of the intake air, and the output voltage of the air flow meter 5 is input to the input port 35 via an A/D converter 37. An $O_2$ sensor 40, as an air-fuel ratio sensor, is arranged in the exhaust manifold 8. The $O_2$ sensor 40 produces an output voltage representing the air-fuel ratio, and the output voltage of the $O_2$ sensor 40 is input to the input port 35 via an A/D converter 41. The output port 36 is connected to the fuel injectors 10 and the solenoid valve 22 via corresponding drive circuits 43.

In the engine shown in FIG. 1, an air-fuel ratio control operation is carried out so that the actual airfuel ratio is maintained at a target ratio, using the output of the $O_2$ sensor 40.

Figure 2:
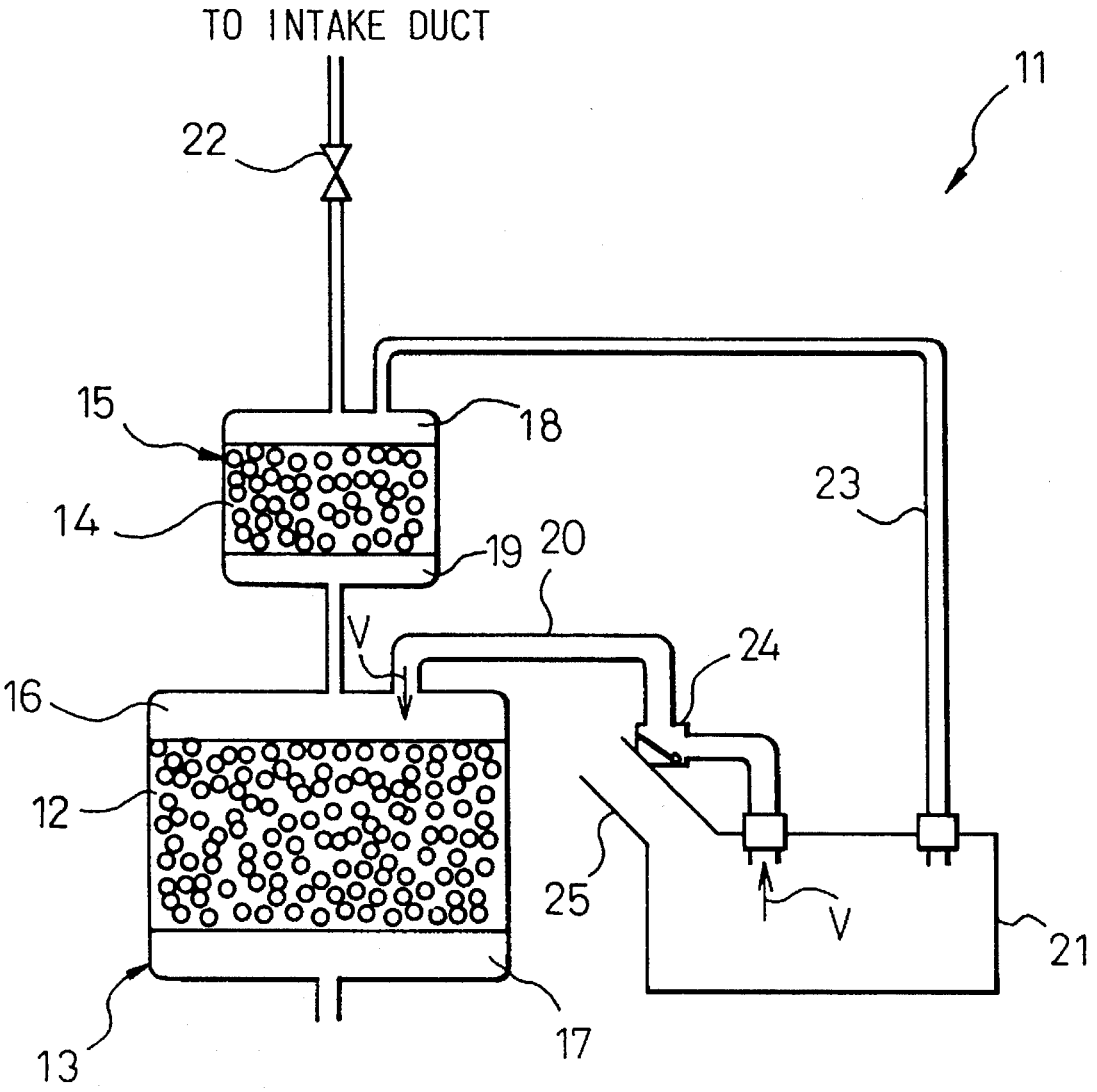
FIG. 2 illustrates an operation of a fuel vapor emission control system during the fuelling operation.

Next, the operation of the system 11 shown in FIG. 1 will be described, with reference to FIGS. 2 through 4.

When a fuelling operation is to be carried out, the cover 21*a* is removed from the fuel tank 21, and then fuel is poured into the tank 21 through the fuel inlet 25. When the fuel is being poured, a large amount of fuel vapor is generated in the tank 21. During the fuelling operation, since the valve 24 opens the first pipe 20 and since the flow resistance of the first pipe 20 is smaller than that of the second pipe 23, almost all of fuel vapor in the fuel tank 21 flows through the first pipe 20, as shown by an arrow V in FIG. 2, into the air-outlet chamber of the primary layer 16. Next, this fuel vapor flows into the primary layer 12 and is adsorbed therein. Accordingly, fuel vapor is not discharged into the outside air. In this connection, during the fuelling operation, the solenoid valve 22 is maintained in a closed condition.

When the fuelling operation is finished, the cover 21*a* is attached to the fuel tank 21 so as to close the fuel inlet 25, and the vent valve 24 then closes the first pipe 20.

When the engine is running, a vacuum is generated in the intake duct 4 downstream of the throttle valve 7. Further, the solenoid valve 22 is controlled so as to be opened. Therefore, the air flows into the air-inlet chamber for the primary layer 17, as shown by an arrow p in FIG. 3. This air then flows into the primary layer 12 and desorbs fuel vapor adsorbed therein. Fuel vapor desorbed from the primary layer 12, together with the air, flows into the secondary layer 14 through, in turn, the air-outlet chamber for the primary layer 16 and the air-inlet chamber for the secondary layer 19. Fuel vapor flowing into the secondary layer 14 is adsorbed therein. On the other hand, the air flowing into the secondary layer 14 desorbs fuel vapor therefrom. Next, the air, together with fuel vapor desorbed from the secondary layer 14, flows into the air-outlet chamber for the secondary layer 18.

Next, fuel vapor and the air are purged into the intake duct 4. Finally, fuel vapor is burned in the combustion chambers of the cylinders la. Accordingly, fuel vapor can be used to produce some of the output power of the engine.

Figure 3:
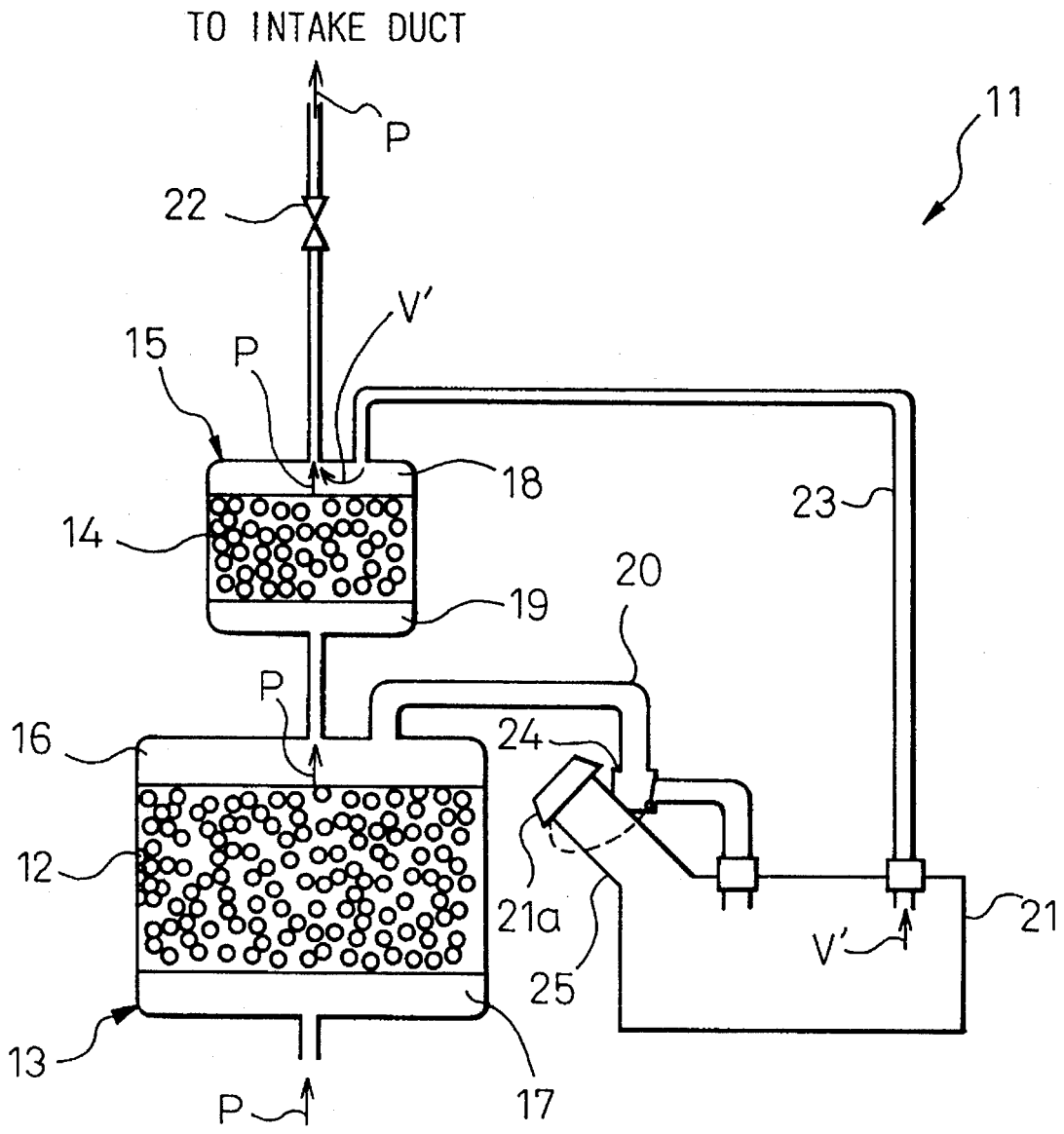
FIG. 3 illustrates an operation of the system during the engine is running.

When the engine is running, fuel vapor generated in the fuel tank 21 flows into the air-outlet chamber for the secondary layer 18 through the second pipe 23, as shown by an arrow V' in FIG. 3. This fuel vapor is then purged into the intake duct 4 with fuel vapor and air flowing from the secondary layer 14 into the air-outlet chamber 18. Therefore, fuel vapor generated when the engine is running is purged into the engine without passing through the primary and the secondary layers 12 and 14. That is, the fuel vapor generated when the engine is running is purged into the engine, bypassing the primary and the secondary layers 12 and 14. By discharging fuel vapor from the fuel tank 21, the fuel tank 21 does not deforms due to a pressure therein.

As the time during which the purging operation is carried out increases, the amount of fuel vapor adsorbed in the primary and the secondary layers 12 and 14 becomes smaller, and finally becomes substantially zero. Therefore, the adsorbing capacities of the primary and the secondary layers 12 and 14 are preserved. Further, since fuel vapor generated when the engine is running bypasses the primary and the secondary layers 12 and 14, the adsorbing capacities of the primary and the secondary layers 12 and 14 are further preserved.

As mentioned above, the large amount of fuel vapor generated during the fuelling operation is introduced and adsorbed in the primary layer 12. Thus, if the engine is driven just after the fuelling operation, the large amount of fuel vapor is desorbed from the primary layer 12. However, in this embodiment, fuel vapor desorbed from the primary layer 12 is introduced into the secondary layer 14, and the fuel vapor is temporarily adsorbed therein. Therefore, a large amount of fuel vapor is not purged into the engine 1. In this situation, when a fuelling operation is to be carried out, the amount of fuel vapor adsorbed in the secondary layer 14 is substantially zero, as described above. Therefore, the secondary layer 14 adsorbs fuel vapor purged from the primary layer 12, and thus a large amount of fuel vapor is still not fed into the engine 1.

Figure 4:
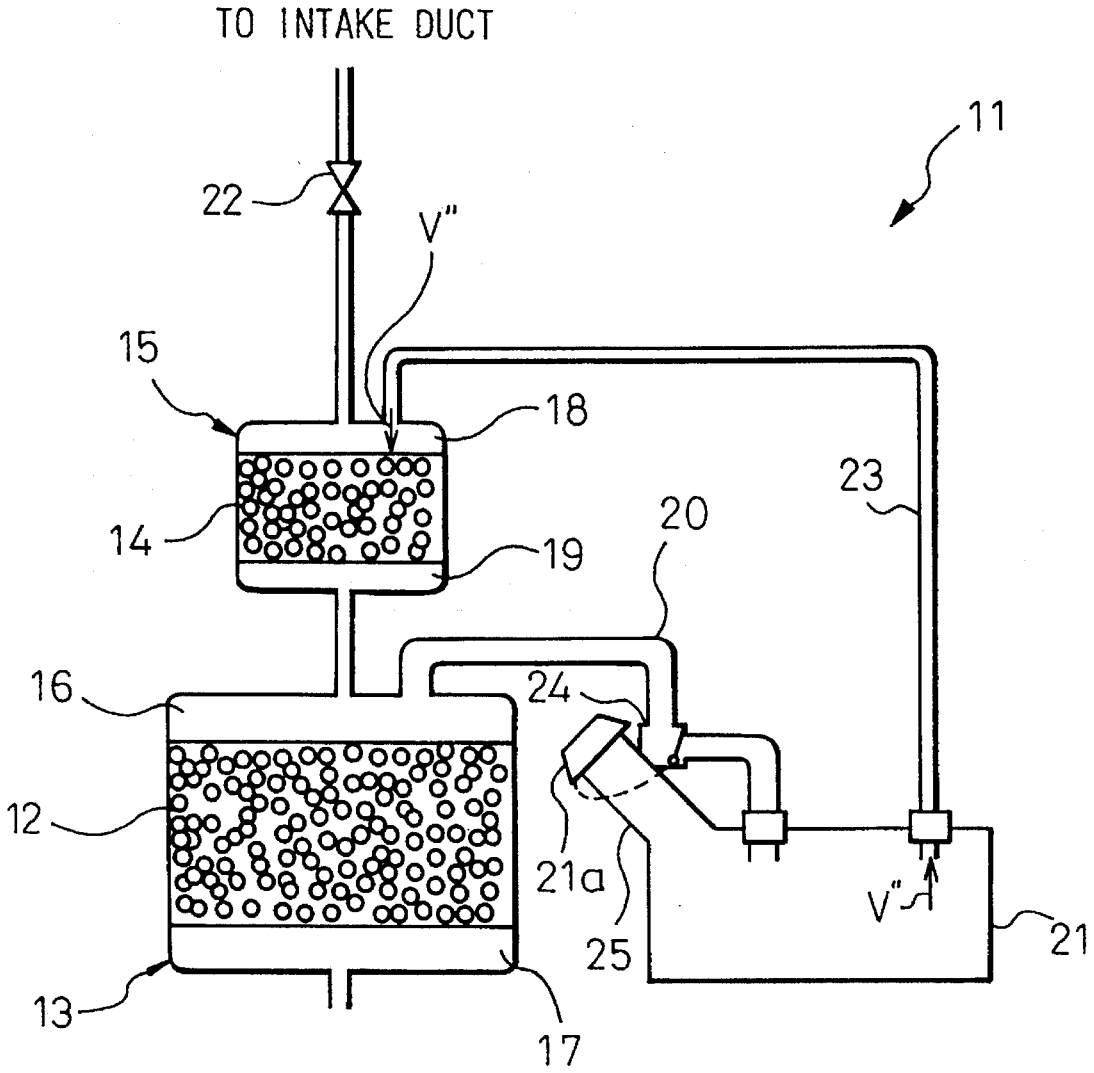
FIG. 4 illustrates an operation of the system when the engine is stopped except during an engine fuelling operation.

On the other hand, fuel vapor generated when the engine is stopped, and the fuelling operation is not being carried out, flows into the air-outlet chamber for the secondary layer 18 through the second pipe 23, and is adsorbed in the secondary layer 14, as shown by an arrow V" in FIG. 4. Since the amount of fuel vapor generated when the engine is stopped, and the fuelling operation is not being carried out, is relatively small, the adsorbing capacity of the secondary layer 14 is not reduced by this fuel vapor.

According to the embodiment shown, the amount of fuel vapor purged into the engine 1 is relatively small just after the fuelling operation, and thus the ratio of the amount of fuel vapor fed into the engine 1 to the amount of fuel injected by the fuel injectors 10 can be made relatively small. Therefore, even if a change of an amount of fuel vapor purged into the engine occurs, the change of the air-fuel ratio is small. Accordingly, the controllability of the air-ratio control operation does not become worse.

A second embodiment according to the present invention will be described with reference to FIG. 5. In this embodiment, similar components are indicated by the same reference numerals used in FIG. 1. Also, in FIG. 5, the engine 1 and the electrical control unit 30 are not depicted.

Figure 5:
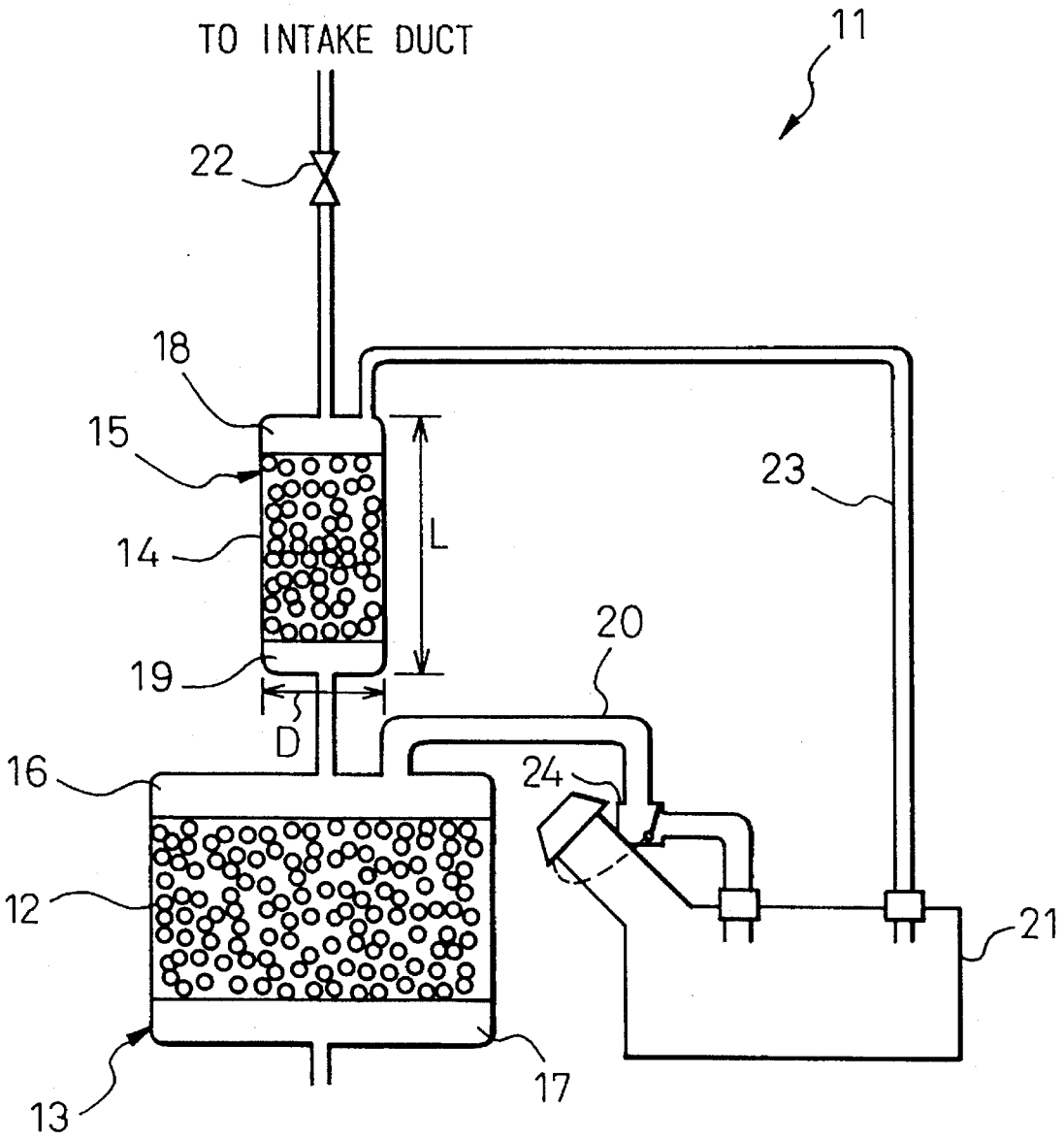
FIG. 5 is a schematic illustration of a fuel vapor emission control system according to a second embodiment of the present invention.

Referring to FIG. 5, the ratio L/D of the length L to the diameter D of the secondary canister 15, is made larger than that of the secondary canister shown in FIG. 1, and thereby the flow resistance of the secondary canister 15 is made larger. Thus, the rate of fuel vapor and air purged from the secondary layer 14 into the engine 1 is made smaller. Also, the rate of fuel vapor and the air purged from the primary layer 12 into the secondary layer 14 is made smaller. Accordingly, it is further prevented that a large amount of fuel vapor is purged into the engine when the engine begins to run just after the fuelling operation.

Further, by making the diameter of the secondary layer 14 smaller, the air flowing through the secondary layer 14 flows through the entire cross-section of the secondary layer 14. Thus, almost all of fuel vapor adsorbed in the secondary layer 14 is easily desorbed therefrom. Therefore, the adsorbing capacity of the secondary layer 14 is further enhanced.

In the embodiment shown in FIG. 5, the ratio L/D is made larger so as to make the flow resistance of the secondary canister 15 larger. Alternatively, the density of the activated carbon within the secondary layer 14 may be made higher. Other operations of the system 11 are substantially same as the embodiment shown in FIG. 1, and the description thereof is omitted.

Figure 6:
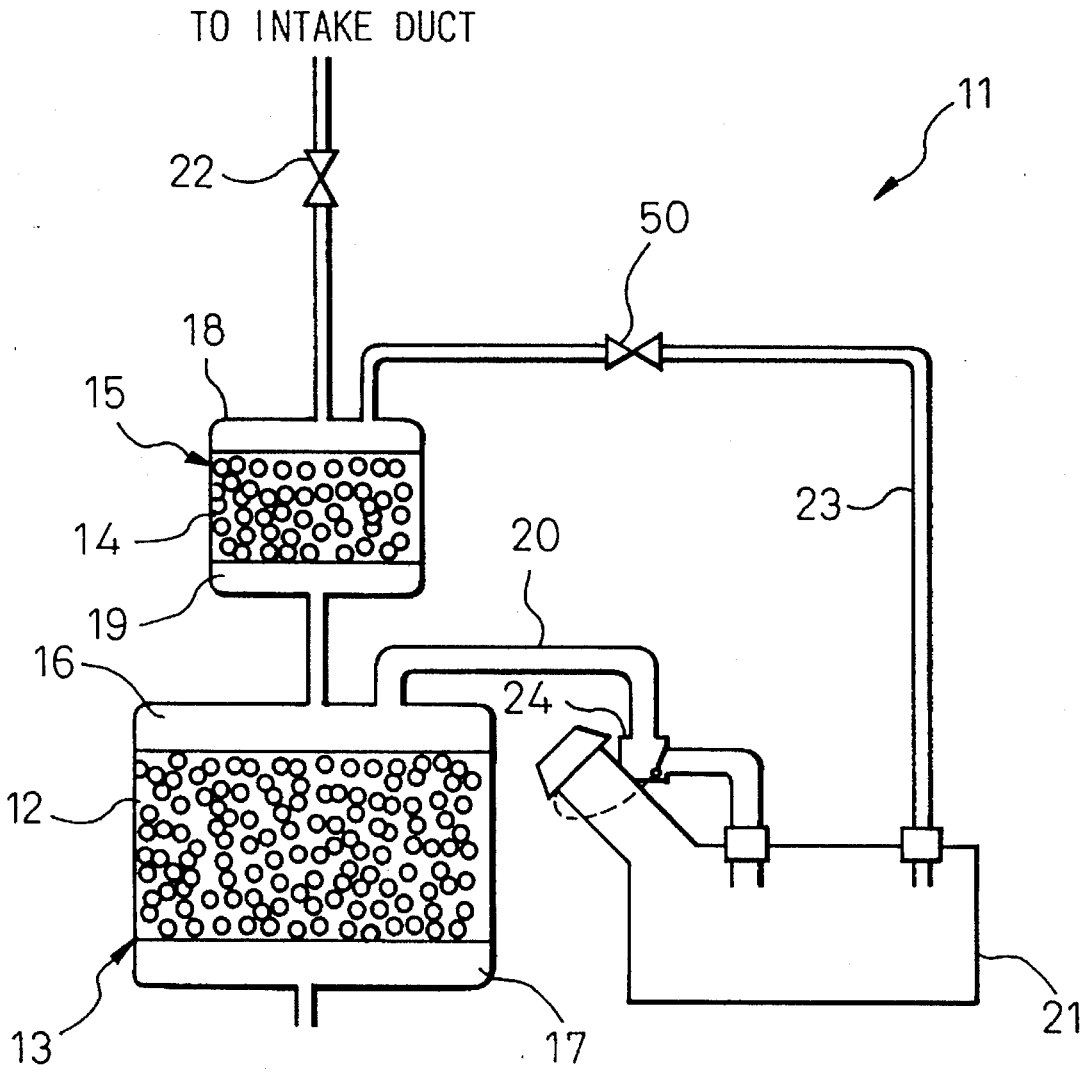
FIG. 6 is a schematic illustration of a fuel vapor emission control system according to a third embodiment of the present invention.

A third embodiment according to the present invention will be described with reference to FIG. 6. In FIG. 6, the engine 1 and the electrical control unit 30 are again not depicted.

Referring to FIG. 6, a check valve 50 is provided in the second pipe 23 for reducing the amount of fuel vapor flowing through the second pipe 23. This check valve 50 allows fuel vapor to flow only from the fuel tank 21 to the air-outlet chamber for the secondary layer 18. The check valve 50 opens when the pressure in the fuel tank 21 exceeds the pressure in the air-outlet chamber 18 by a predetermined value. On the other hand, in this embodiment, the flow resistance of the secondary canister 15 is made same as that of the embodiment shown in FIG. 1.

When the flow resistance of the secondary canister 15 is made higher as in the embodiment shown in FIG. 5, the amount of fuel vapor purged from the primary and the secondary layers 12 and 14 to the engine is reduced. In this case, a relatively longer period is required in order to desorb almost all of the fuel vapor therefrom. Therefore, the adsorbing capacity of the primary and the secondary layers 12 and 14 may be small when a fuelling operation is to be carried out.

However, in this embodiment, the check valve 50 is provided for reducing the amount of fuel vapor purged into the engine through the second pipe 23 when the engine is running, especially just after the fuelling operation. Since, just after the fuelling operation, the temperature of the fuel in the fuel tank 21 is relatively low, and since the fuel vapor generated during the fuelling operation is introduced into the primary layer 14, the amount of fuel vapor in the fuel tank 21 is relatively small at this time. Therefore, the check valve 50 is maintained at a closed position for a certain period just after the fuelling operation. Thus, when the check valve 50 is closed, fuel vapor is purged into the engine only from the primary and the secondary layers 12 and 14. Accordingly, a large amount of fuel vapor is not fed into the engine 1 even though the flow resistance of the secondary layer 14 is not higher. Further, the adsorbing capacity of the primary and the secondary layers 12 and 14 is ensured when the fuelling operation is to be carried out. Furthermore, since the pressure in the fuel tank 21 is able to increase until it reaches the opening pressure thereof, it is difficult for liquid fuel in the tank to evaporate, due to the high pressure in the tank 21. Therefore, the amount of fuel vapor generated, after the fuelling operation, is made smaller.

Figure 7:
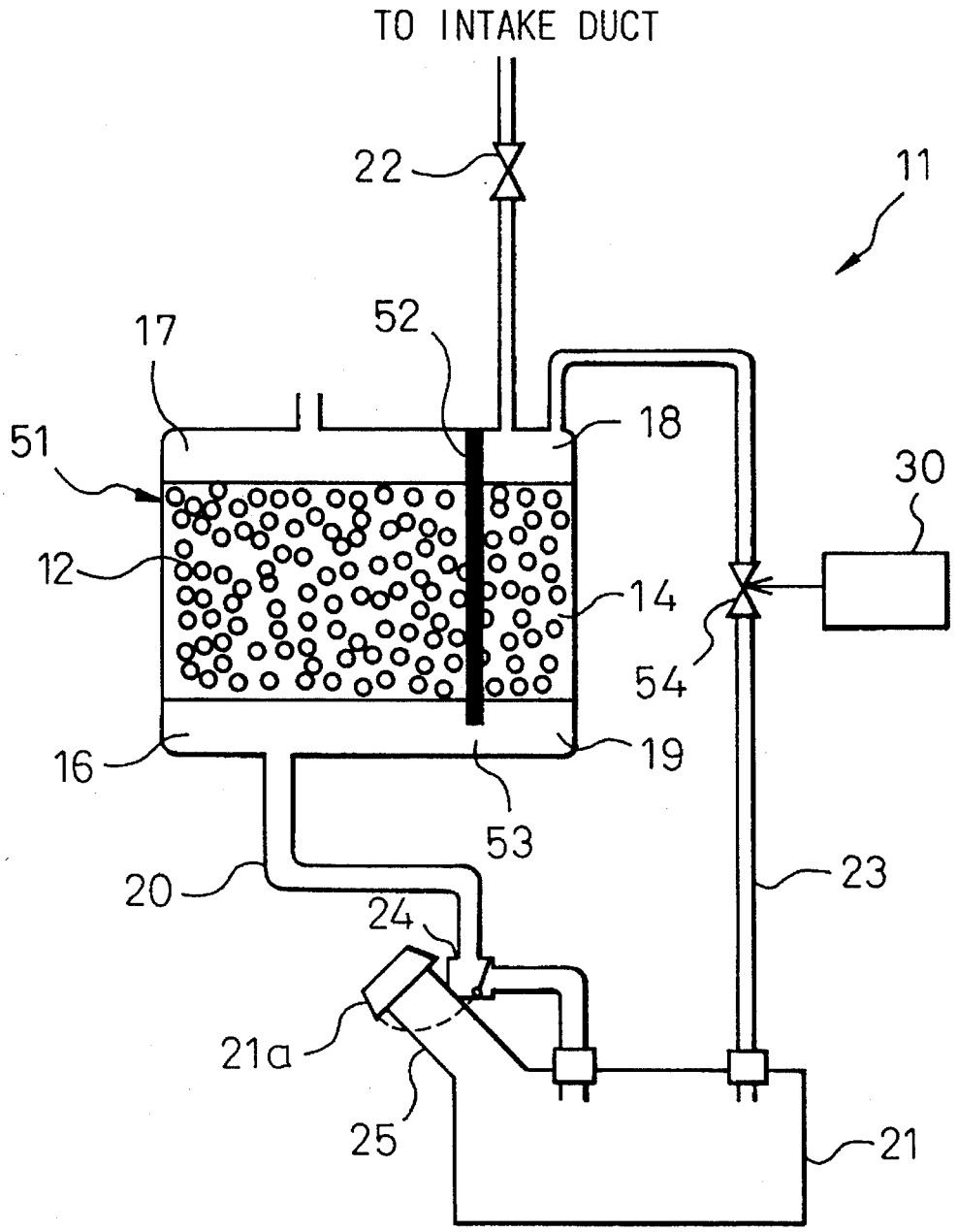
FIG. 7 is a schematic illustration of a fuel vapor emission control system according to a fourth embodiment of the present invention.

A fourth embodiment according to the present invention will be described with reference to FIG. 7. In FIG. 7, the engine 1 is not depicted, and the electrical control unit 30 is simply depicted as a box.

Referring to FIG. 7, the system 11 comprises a single charcoal canister 51. Within the canister 51, the primary and the secondary layers 12 and 14 are housed side-by-side, and are separated from each other by a wall 52. The air-inlet chamber for the primary layer 17 and the air-outlet chamber for the secondary layer 18 are arranged side-by side, and are separated by the wall 52. The air-outlet chamber for the primary layer 16 and the air-inlet chamber for the secondary layer 19 are arranged side-by side, and are connected via a slot defined between the wall 52 and the inside surface of the canister 51.

As shown in FIG. 7, a check valve 54 is provided in the second pipe 23. The check valve 54 allows fuel vapor to flow only from the tank 21 to the air-outlet chamber for the secondary layer 18 when the pressure in the fuel tank 21 exceeds the pressure in the air-outlet chamber 18 by a selected value. The opening pressure of the check valve 54 is different depending upon the engine operating conditions. That is, the opening pressure of the check valve 54 when the engine is running is predetermined to be lower than the opening pressure when the engine is stopped. The opening pressure of the check valve 54 is controlled by, for example, signals output from the electronic control unit 30. Alternatively, the opening pressure of the check valve 54 is controlled mechanically.

When the engine is stopped, the check valve 54 reduces the amount of fuel vapor flowing from the fuel tank 21 into the air-outlet chamber 18. To this end, the amount of fuel vapor being adsorbed in the secondary layer 14 is reduced when the engine is stopped. Therefore, the adsorbing capacity of the secondary layer 14 is not lowered when the engine operation is to be started.

If the opening pressure of the check valve 54 when the engine is running is predetermined to be higher than the opening pressure when the engine is stopped, the amount of fuel vapor flowing through the second pipe 23 when the engine is running is made smaller. Therefore, in this case, the pressure in the fuel tank 21 may be higher than the atmospheric pressure when the fuelling operation is to be carried out. In this situation, if the cover 21*a* is removed from the fuel tank 21, fuel vapor in the tank 21 is discharged into the outside air through the fuel inlet 25.

However, in the embodiment shown in FIG. 7, the opening pressure of the check valve 54 when the engine is running is predetermined to be lower than the opening pressure when the engine is stopped. Therefore, fuel vapor relatively easily flows from the fuel tank 21 when the engine is running. Accordingly, that the pressure in the tank 21 when the engine is running does not exceed atmospheric pressure. Therefore, fuel vapor in the tank 21 is not discharged into the outside air through the fuel inlet 25 when the cover 21*a* is removed from the fuel tank 21.

Figure 8:
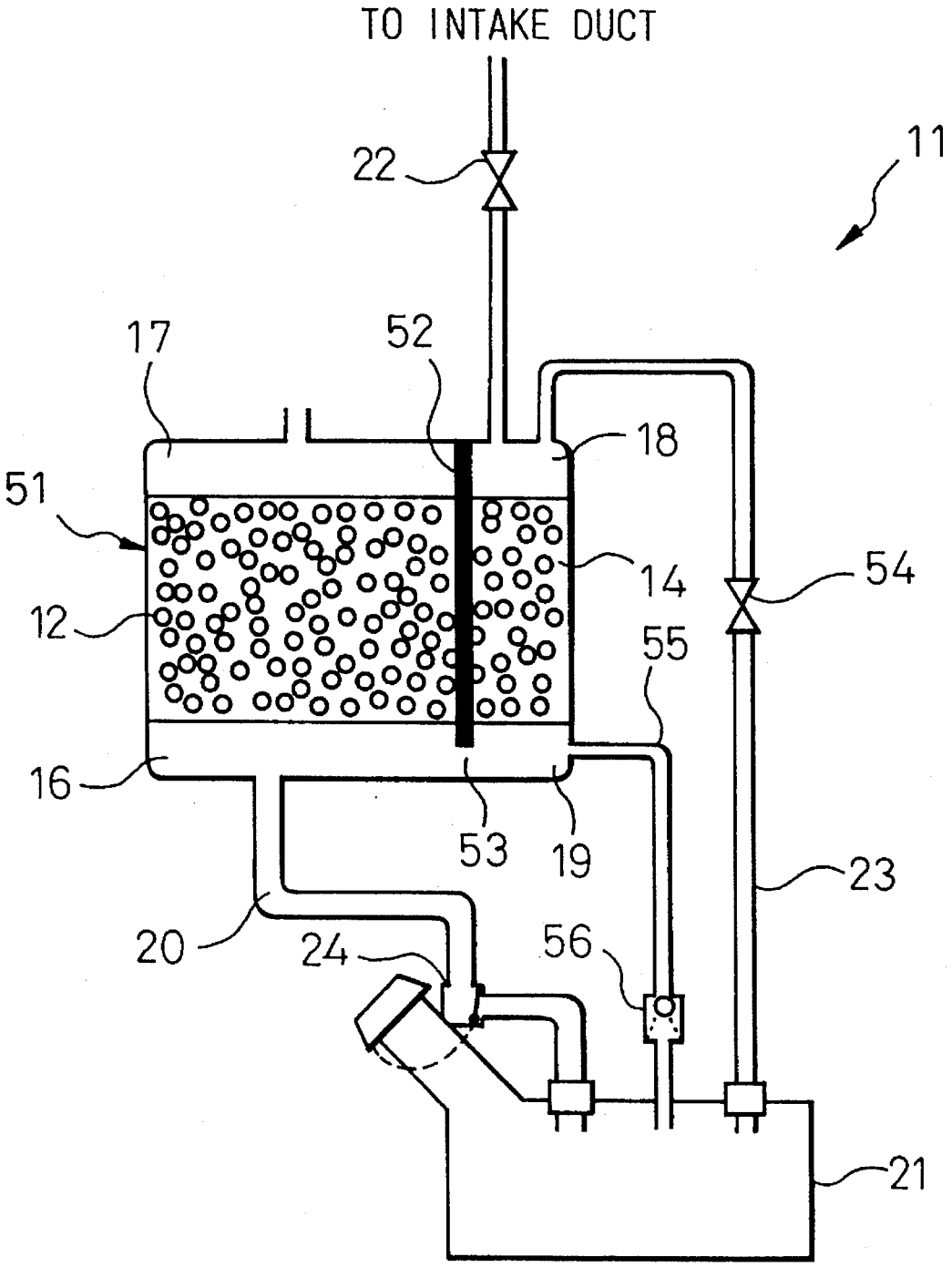
FIG. 8 is a schematic illustration of a fuel vapor emission control system according to a fifth embodiment of the present invention.

A fifth embodiment according to the present invention will be described with reference to FIG. 8. In FIG. 8, the engine 1 and the electrical control unit 30 are not depicted.

Referring to FIG. 8, the system 11 according to this embodiment is constructed as shown in FIG. 7. However, the system 11 further comprises a third pipe 55 connecting the fuel tank 21 to the air-inlet chamber for the secondary layer 19, and a check valve 56 is provided in the third pipe 55. The check valve 56 allows fuel vapor to flow from the air-inlet chamber 19 toward the fuel tank 21.

As the time during which the engine is running increases, the liquid fuel in the fuel tank 21 is gradually heated, and thereby the temperature inside the tank 21 increases. Therefore, the pressure in the tank 21 may be relatively high just after the engine is stopped. On the other hand, after the engine is stopped, the temperature inside the fuel tank 21 gradually falls. Therefore, the pressure in the tank 21 also falls gradually, and finally a vacuum may be generated in the tank 21. The vacuum in the tank 21 functions to desorb fuel vapor from, especially, the secondary layer 14. The fuel vapor desorbed by the vacuum in the tank 21 flows into the tank 21, through the third pipe 55 and through the check valve 56. Accordingly, the adsorbing capacity of the secondary layer 14 is further enhanced.

In this embodiment, the third pipe 55 is connected to the air-inlet chamber for the secondary layer 19. Alternatively, the third pipe 55 may be connected to the air-outlet chamber for the secondary layer 18. However, since fuel vapor flows into the secondary layer 14 through the surface facing the air-inlet chamber 19, it is advantageous to connect the third pipe 55 to the air-inlet chamber 19, for desorbing the fuel vapor therefrom. Also, alternatively, the third pipe 55 may be connected to the air-inlet and the air-outlet chambers for the primary layer 16 and 17. Further, alternatively, the third pipe 55 may be connected to a plurality of the chambers 16, 17, 18 and/or 19.

According to the present invention, it is possible to prevent a large amount of fuel vapor being fed into the engine while ensuring that fuel vapor is not discharged into the outside air.

While the invention has been described by reference to specific embodiments chosen for purposes of illustration, it should be apparent that numerous modifications could be made thereto by those skilled in the art without departing from the basic concept and scope of the invention.

We claim:

1. A fuel vapor emission control system for connection to an engine having a fuel tank so as to purge fuel vapor introduced thereto into the engine, the system comprising:

primary and secondary adsorbing layers for temporarily adsorbing fuel vapor introduced thereto, the primary and the secondary layers being connected in series;

fuel vapor introducing means for introducing fuel vapor, from the fuel tank, into the primary layer during an engine fuelling operation, and for introducing fuel vapor from the fuel tank into the engine bypassing the primary and the secondary layers when the engine is running; and air introducing means for introducing air into, in turn, the primary and the secondary layers so that the air passing therethrough desorbs fuel vapor therefrom, and then into the engine, together with the fuel vapor desorbed from the primary and the secondary layers, when the engine is running.

2. A system according to claim 1, wherein fuel vapor introducing means introduces fuel vapor from the fuel tank to the secondary layer when the engine is stopped except during an engine fuelling operation.

3. A system according to claim 2, wherein the system further comprises a chamber between the secondary layer and the engine, the chamber being connected to the engine via a valve and to the fuel tank, and wherein the valve is opened when the engine is running and is closed when the engine is stopped.

4. A system according to claim 3, wherein the fuel tank is connected to the chamber via a check valve, the check valve allowing fuel vapor to flow only from the fuel tank to the chamber when the pressure difference between the pressures in the fuel tank and in the chamber reaches a predetermined value.

5. A system according to claim 4, wherein the opening pressure of the check valve when the engine is running is predetermined to be lower than the opening pressure when the engine is stopped.

6. A system according to claim 1, wherein fuel vapor introducing means comprises a pipe for introducing fuel vapor, from the fuel tank, into the primary layer, and a vent valve is provided in the pipe, and wherein the vent valve normally closes the pipe and opens the pipe during an fuelling fuelling operation.

7. A system according to claim 6, wherein the vent valve cooperates with a cover provided at an end of a fuel inlet of the fuel tank in a manner that the vent valve closes the pipe when the cover is attached to the fuel inlet, and opens the pipe when the cover is removed from the fuel inlet.

8. A system according to claim 1, wherein the system further comprises returning means for desorbing fuel vapor from at least one of the primary and the secondary layers so that fuel vapor is returned to the fuel tank when the engine is stopped.

9. A system according to claim 8, wherein returning means comprises a pipe for introducing fuel vapor from the layer to the fuel tank, and a check valve is provided in the pipe, the check valve allowing fuel vapor to flow only from the layer to the tank, and wherein returning means desorbs fuel vapor by using a vacuum generated in the fuel tank as temperature inside the fuel tank falls after the engine is stopped.

10. A system according to claim 8, wherein the returning means desorbs fuel vapor from the secondary layer.

11. A system according to claim 1, wherein the system is connected to an intake passage downstream of a throttle valve of the engine, whereby air introducing means introduces the air into the primary and the secondary layers by using a vacuum generated in the intake passage downstream of the throttle valve.

12. A system according to claim 1, wherein the system further comprises: a primary charcoal canister in which the primary layer is housed; a secondary charcoal canister in which the secondary layer is housed; an air-inlet chamber arranged on one side of the primary layer within the primary canister, the air-inlet chamber being connected to the outside air; an air-outlet chamber arranged on another side of the primary layer within the primary canister; another air-inlet chamber arranged on one side of the secondary layer within the secondary canister, the air-inlet chamber of the secondary canister being connected to the air-outlet chamber of the primary canister; another air-outlet chamber arranged on another side of the secondary layer within the secondary canister, the air-outlet chamber of the secondary canister being connected to an intake passage downstream of a throttle valve of the engine; a first pipe connecting the fuel tank to the air-outlet chamber of the primary canister; a second pipe connecting the fuel tank to the air-outlet chamber of the secondary canister, the second pipe having a flow resistance larger than that of the first pipe; and a vent valve provided in the first pipe, the vent valve normally closing the first pipe and opening the first pipe during the fuelling operation.

13. A system according to claim 12, wherein a valve is provided between the air-outlet chamber of the secondary canister and the intake passage, the valve being open when the engine is running and closed when the engine is stopped.

14. A system according to claim 1, wherein the system further comprises: a single charcoal canister in which the primary and the secondary layers are housed side-by-side; a wall provided within the canister for separating the primary and the secondary layers; an air-inlet chamber arranged on one side of the primary layer within the canister, the air-inlet chamber being connected to the outside air; an air-outlet chamber arranged on another side of the primary layer within canister; another air-inlet chamber arranged on one side of the secondary layer within the canister, the air-inlet chamber for the secondary layer being connected to the air-outlet chamber for the primary layer via a slot defined between the wall and the inside surface of the canister; another air-outlet chamber arranged on another side of the secondary layer within the canister, the air-outlet chamber for the secondary layer being separated from the air-inlet chamber for the primary layer by the wall and connected to an intake passage downstream of a throttle valve of the engine; a first pipe connecting the fuel tank to the air-outlet chamber for the primary layer; a second pipe connecting the fuel tank to the air-outlet chamber for the secondary layer, the second pipe having a flow resistance larger than that of the first pipe; and a vent valve provided in the first pipe, the vent valve normally closing the first pipe and opening the first pipe during the fuelling operation.

15. A system according to claim 14, wherein a valve is provided between the air-outlet chamber for the secondary layer and the intake passage, the valve being open when the engine is running and closed when the engine is stopped.

16. A system according to claim 1, wherein each of the primary and the secondary adsorbing layers comprises activated carbon.

* * * * *

UNITED STATES PATENT AND TRADEMARK OFFICE

CERTIFICATE OF CORRECTION

PATENT NO. : 5,477,836

DATED : December 26, 1995

INVENTOR(S) : Yoshihiko et al.

It is certified that error appears in the above-indentified patent and that said Letters Patent is hereby corrected as shown below:

| Column | Line | |
|---|---|---|
| 2 | 23 | Change "during" to --when--. |
| 3 | 30 | Change "operates it" to --operate--. |
| 4 | 50 | Change "deforms" to --deform--. |
| 7 | 22 | Delete "that". |
| 8 | 50 | Delete "fuelling" (second occurrence). |

Signed and Sealed this

Eighteenth Day of June, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,477,836
DATED : December 26, 1995
INVENTOR(S) : Yoshihiko HYODO, et al.

It is certified that error appears in the above-indentified patent and that said Letters Patent is hereby corrected as shown below:

| Column | Line | |
|---|---|---|
| 2 | 23 | Change "during" to --when--. |
| 3 | 30 | Change "operates it" to --operate--. |
| 4 | 50 | Change "deforms" to --deform--. |
| 7 | 22 | Delete "that". |
| 8 | 50 | Delete "fuelling" (second occurrence). |

This certificate supersedes Certificate of Correction issued June 18, 1996.

Signed and Sealed this

Twenty-fourth Day of September, 1996

*Attest:*

*Attesting Officer*

BRUCE LEHMAN

*Commissioner of Patents and Trademarks*